US009873202B2

(12) United States Patent
Lake

(10) Patent No.: US 9,873,202 B2
(45) Date of Patent: Jan. 23, 2018

(54) KNIFE HAVING TOOLS IN THE HANDLE

(71) Applicant: Ronald W. Lake, Eugene, OR (US)

(72) Inventor: Ronald W. Lake, Eugene, OR (US)

( * ) Notice: Subject to any disclaimer, the term of this patent is extended or adjusted under 35 U.S.C. 154(b) by 0 days.

(21) Appl. No.: 14/808,061

(22) Filed: Jul. 24, 2015

(65) Prior Publication Data

US 2016/0167240 A1 Jun. 16, 2016

Related U.S. Application Data

(60) Provisional application No. 61/999,395, filed on Jul. 25, 2014.

(51) Int. Cl.
*B26B 11/00* (2006.01)

(52) U.S. Cl.
CPC ..... *B26B 11/00* (2013.01)

(58) Field of Classification Search
CPC ..... B26B 11/005; B26B 11/003; B26B 11/00; B25G 1/08
USPC ..... 30/255, 226, 156, 177, 175, 131, 132, 30/186, 155, 160; 7/118, 160
See application file for complete search history.

(56) References Cited

U.S. PATENT DOCUMENTS

| | | | | |
|---|---|---|---|---|
| 4,783,867 | A | 11/1988 | Tsao | |
| 5,125,157 | A | 6/1992 | Howard | |
| 5,553,340 | A * | 9/1996 | Brown, Jr. | B25F 1/04 7/118 |
| 5,581,834 | A * | 12/1996 | Collins | B26B 11/00 30/155 |
| 6,675,419 | B2 | 1/2004 | Rivera | |
| 8,464,382 | B2 | 6/2013 | Chu | |
| 9,008,585 | B2 | 4/2015 | Salin et al. | |
| 2015/0079258 | A1 * | 3/2015 | Szymanski | A47J 17/02 426/479 |

FOREIGN PATENT DOCUMENTS

| | | | | |
|---|---|---|---|---|
| EP | 0652082 | A1 * | 5/1995 | A45D 26/0066 |

* cited by examiner

*Primary Examiner* — Omar Flores Sanchez
(74) *Attorney, Agent, or Firm* — Teri G. Andrews, Patent Agent

(57) ABSTRACT

A knife having a tool in the handle has a blade at one end and a tang at an opposite end. A first handle has a receiving slot disposed and centered lengthwise on the interior surface. A second handle has a receiving slot disposed and centered lengthwise on its interior surface. The tool has two legs that are parallel, and have a thumb stud on one leg.

First and second handles are attached to opposing sides of the tang. The tool is inserted into the knife by the legs entering the first and second receiving slots while straddling the tang.

20 Claims, 4 Drawing Sheets

KNIFE HAVING TOOLS IN THE HANDLE

CROSS-REFERENCE TO RELATED APPLICATIONS

This application claims priority under 35 U.S.C. §119(e) to U.S. Provisional Application Ser. No. 61/999,395 entitled "Knives Having Small Tools in Handle", filed Jul. 25, 2014, the entire disclosure of which is herein incorporated by reference for all purposes.

BACKGROUND OF THE INVENTION

Field of the Invention

This invention relates to sports knives—both fixed blade and folding knives, and more particularly to knives having small tools in the handle.

Background of the Invention

Knives having tools inserted in the handle are well known in the prior art. They range from knives having a single tool that Inserts into the handle of the knife to knives have many tools, commonly known as multi-tool knives Typically, these knives are folding knives that become bulky due to the tool or tools being it inserted in one side or both sides of the handle. It is common with these multi-tool knives for the tools to eventually become thin or sloppy in the slot thus they eventually tend to fall out. Additionally, these tools are very small, difficult to handle, and tend to break or lose strength over time and use.

A single tool knife example is disclosed in U.S. Pat. No. 5,125,157 issued to Howard showing a small tool or a toothpick that is inserted between the sideplates of the knife and above the locking bar spring. The tools that will fit in this knife are very small, i.e. toothpick, small screwdriver, or the like. Due to the small size requirement of the tool, the tool is inherently weak or flimsy. These very small tools are not very practical or strong and are often difficult to handle as one with larger hands can appreciate.

Alternately, U.S. Pat. No. 8,464,382 issued to Chu discloses a multi-functional folding knife having a cutting surface on one edge of the blade and a variety of tools cut into the opposite edge of the blade, such as a bottle opener and a rope cutter. Although this knife is thinner and less bulky, the tools out into the blade significantly degrade the strength of the blade and risk bending the blade with aggressive use.

U.S. Pat. No. 9,003,585 issued to Salin et al. is an example of a pocketknife having multiple tools included in the handle. Salin discloses a pocketknife that separates into at least two separate knife portions such that each portion can be used separately such as a knife and fork for eating. As one can imagine, in order for this knife to actually fit into ones pocket, the tools must be very small, thus thin and of minimal strength and usefulness.

There is a need for placing practical working tools or instruments into handles of a knife, folding or fixed blade, that one can easily utilize that do not compromise the size and usefulness of the knife.

Objectives and Advantages of the Present Invention

It is a primary objective of the present invention to provide a knife, folding or fixed blade, having a tool in the handle that is of greater strength and more practical than the prior art knives without increasing the size or thickness of the knife handle.

It is another objective of the present invention to provide a knife having a practical, removable tool wherein the tool can be easily yet securely inserted into the handle of the knife when not in use minimizing the possibility of the tool inadvertently falling out.

It is yet another objective of the present invention to provide a knife having a useful tool removable from the knife handle that is simplistic in design for ease of manufacturing.

SUMMARY OF THE INVENTION

It is, therefore, the objective of the present intention to provide a knife, folding or fixed blade, that has a tool in the handle that is of greater strength and more practical than the prior art knives without increasing the size or thickness of the knife handle wherein the tool can be easily yet securely inserted into the handle of the knife when not in use minimizing the possibility of the tool inadvertently falling out, and the knife has a useful tool removable from the knife handle that is simplistic in design for economical manufacturing.

The present invention is knife having a tool in the handle. The knife has a blade at a distal end and a knife base and tang at an opposite end. The tang has a thickness and an end recess. There is a first handle that has a first handle recess and a first handle interior surface that has a first handle receiving slot disposed lengthwise approximately centered on the first handle interior surface.

There is a second handle that has a second handle interior surface that has a second handle receiving slot disposed lengthwise approximately centered on the second handle interior surface.

The tool for the knife has a first leg and a second leg that are essentially parallel and attached to either side of a spacer at the first leg end and the second leg end. The tool has a thumb stud disposed on the first leg on a side opposite the spacer for inserting and removing the tool from the knife by the user's thumb. When in place, the thumb stud extends slightly beyond the first handle.

The first handle is attached to the tang on one side and the second handle is attached to the tang on the opposite side. The tool is inserted into the knife at the knife base by the first leg and the second leg entering the first handle receiving slot and the second handle receiving slot, respectively, while straddling the tang of the knife.

BRIEF DESCRIPTION OF THE DRAWINGS

The above description and other objectives, advantages, and features of the present invention will be more fully understood and appreciated by reference to the specification and accompanying drawings, wherein:

FIG. 2 is a side view of a fixed blade knife with the handles on either side removed depicting the preferred architecture of the deflection slot in the tang of the blade and the end recess.

FIG. 3*a* is a rear view of a knife detailing the receiving slots for placement of the knife tool of the present invention.

FIGS. 3*b-c* are interior views of the knife handles detailing the receiving slots for the knife tool of the present invention.

| DRAWING - Reference Numbers: | |
|---|---|
| 100 | Knife |
| 102 | Blade |
| 104 | 1st Handle |
| 105 | 2nd Handle |
| 106 | Assembly Pins |
| 108 | Detent Pin |
| 110 | Tool |
| 112 | Thumb Stud |
| 114 | Tang |
| 116 | Knife Base |
| 204 | Assembly Holes |
| 206 | Deflection Slot |
| 208 | End Recess |
| 302 | 1st Receiving Slot |
| 303 | 1st Handle Interior |
| 304 | 2nd Receiving Slot |
| 305 | 2nd Handle Interior |
| 306 | 1st Handle Recess |
| 308 | 2nd Handle Recess |
| 402 | 1st Leg |
| 404 | 2nd Leg |
| 406 | Spacer |
| 407 | Tool Lip |
| 408 | Serrated Ridges |
| 500 | Alternate Tool |
| 502 | Spacer Rivet |
| 503 | Rivet Aperture |
| 504 | Thumb Sleeve |
| 505 | Sleeve Aperture |
| 506 | Abrasive Coating |
| 507 | Alternate Spacer |
| 508 | Hex Hole |
| 509 | Spacer Top |
| 510 | Hex Wrench |
| 511 | Spacer Bottom |
| 512 | Screw Driver |
| 513 | Rivet Base |
| 600 | Folding Knife |
| 601 | Folding Knife Blade |
| 602 | 1st Liner |
| 603 | 1st Liner Receiving Slot |
| 604 | 2nd Liner |
| 605 | 2nd Liner Receiving Slot |
| 606 | Alternate Tang |
| 610 | 2nd Alternate Tool |
| 612 | Blade Pivot Bolt |
| 614 | Blade Stop Pin |

DETAILED DISCUSSION OF THE DRAWINGS

Figure 1:
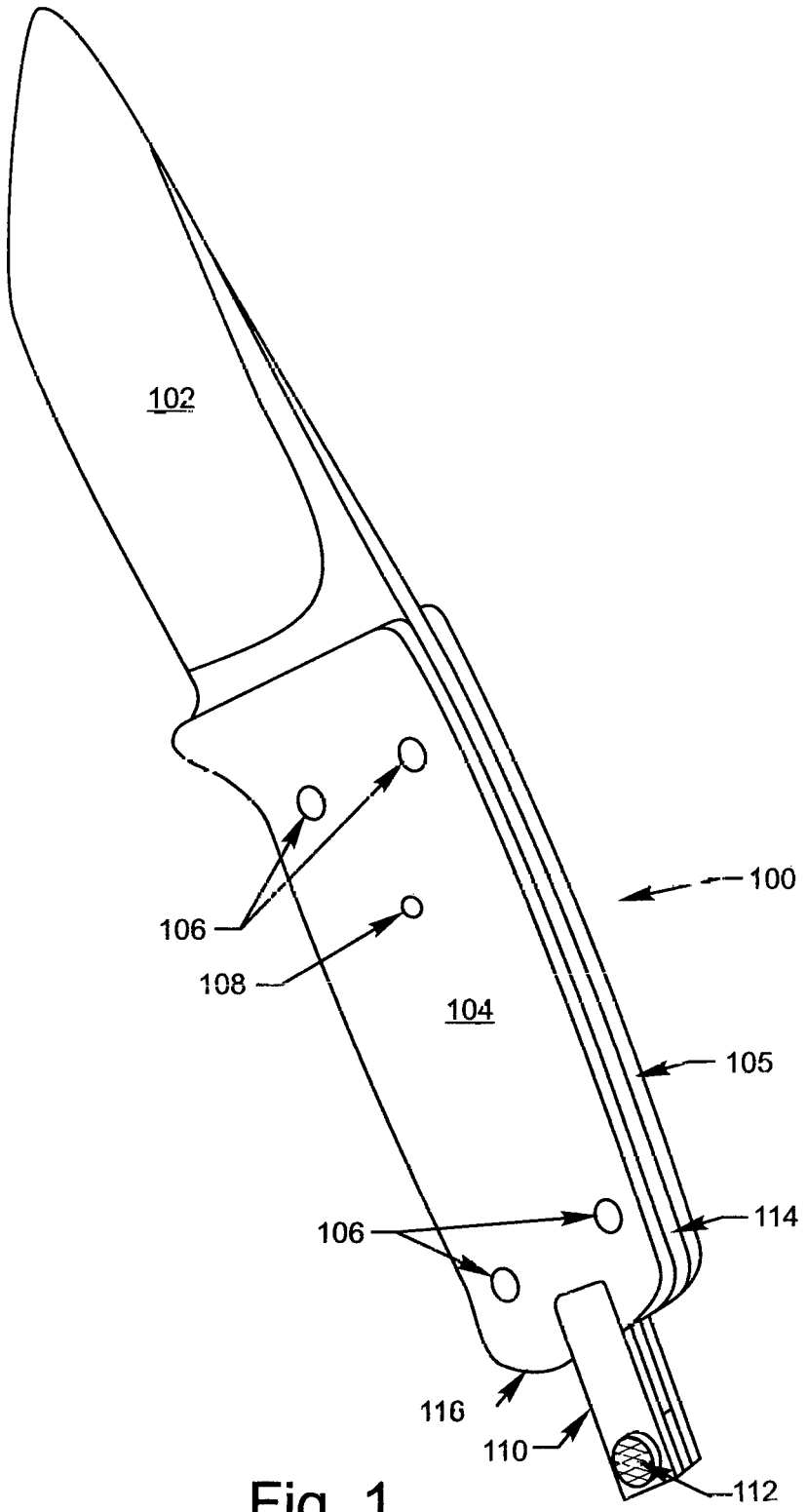
FIG. 1 is a perspective view of a knife having a tool in the handle according to the preferred embodiment of the present invention.

FIG. 1 is a perspective view of Knife 100 having Tool 110 in the handle according to the preferred embodiment of the present invention. As shown, Knife 100 is a fixed blade knife often referred to as a hunting knife. Blade 102 extends from Knife 100 with Tang 114 being the opposite end of Knife 100.

Assembly Pins 106 extend through 1st Handle 104, Tang 114, and 2nd Handle 105 fixedly attaching the three pieces as shown in FIG. 1. Detent Pin 108 extends through 1st Handle 104 such that the end (not shown) of Detent Pin 108 is able to engage Serrated Ridges 408 (not shown) of Tool 110 holding it firmly in place when inserted into Knife 100. Detent Pin 108 in the preferred embodiment is a pin with a rounded end. However, Detent Pin 108 could also be a common ball screw which can be easily replaced when worn or adjusted to increase or decrease the engagement pressure on Tool 110 to the user's liking.

Tool 110, as shown, slides into Knife 100 at Knife Base 116 by bridging or straddling Tang 114. By straddling Tang 114, Tool 110 can be constructed more robustly that a small tool that fits into only one side of the knife handle as is typical of the prior art. The construction of Tool 110 is detailed in the FIGS. 3*a* through 3*c* discussions. Tool 110 includes Thumb Stud 112 for easily sliding Tool 110 in and out of Knife 100 with the user's thumb. The surface of Thumb Stud 112 in the preferred embodiment has a knurled surface for user contact. Thumb Stud 112 can be on one or both sides of Tool 110 and can be used as a finger rest or guard while using Tool 110.

FIG. 2 is a side view of Knife 100 with the handles on either side removed depicting the preferred architecture of Deflection Slot 206 disposed is Tang 114. Deflection Slot 206 allows the legs (not shown) of Tool 110 to be compressed toward one another when inserted into Knife 100. End Recess 208 allows Tool 110 to be inserted into Knife 100 such that Tool 110 remains flush with Knife Base 116 when inserted. In the preferred embodiment, Assembly Holes 204 are shown in four places on Tang 114, but it is has been contemplated to have two or three.

FIG. 3*a* is a view of Knife Base 116 of Knife 100 detailing the placement of the receiving slots for insertion of Tool 110 of the present invention. First Receiving Slot 302 is disposed in 1st Handle 104 while 2nd Receiving Slot 304 is disposed in 2nd Handle 105. Tool 110 bridges or straddles Tang 114 with 1st Leg 402 (not shown) entering 1st Receiving Slot 302 and 2nd Leg 404 (not shown) entering 2nd Receiving Slot 304 simultaneously.

Figure 3B:
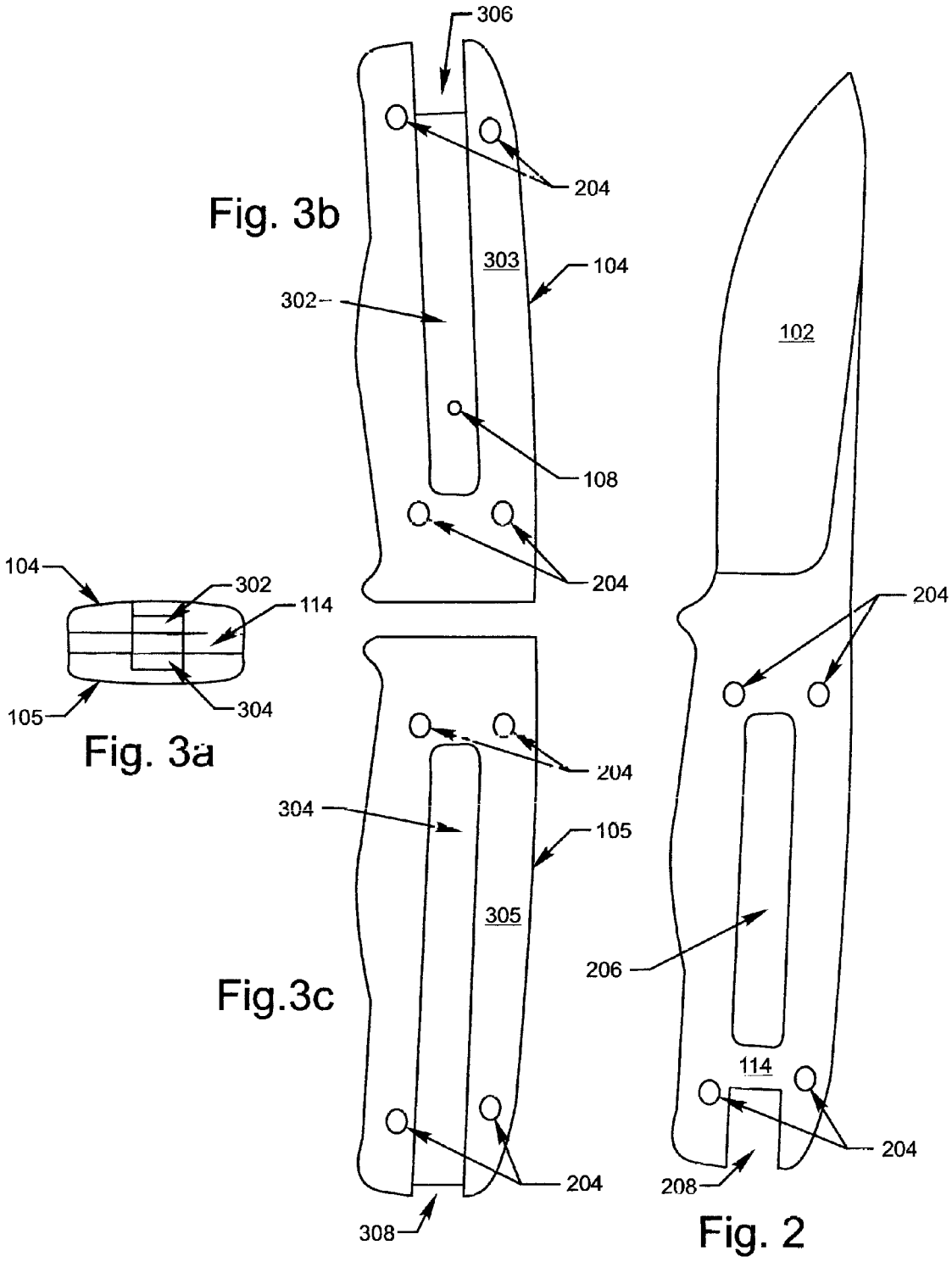

FIG. 3*b* is an interior view of 1st Knife Handle 104 depicting the placement of 1St Receiving Slot 302 disposed on 1st Handle Interior Surface 303. First Handle Recess 306 accommodates Thumb Stud 112 (not shown) such that with Tool 110 (not shown) inserted into Knife 100, the only element protruding from Knife 100 is Thumb Stud 112 which extends from 1st Handle 104 just enough to be caught by the user's thumb. Assembly Holes 204 are shown disposed in 1st Handle 104 and align with Assembly Holes 204 shown on Tang 114.

FIG. 3*c* is an interior view of 2nd Knife Handle 105 depicting the placement of 2nd Receiving Slot 304 disposed on 2nd Handle Interior Surface 305. Assembly Holes 204 are shown disposed in 2nd Handle 105 and align with Assembly Holes 204 in both 1St Handle 104 and Tang 114 such that Assembly Pins 106 (not shown) extend through 1st Knife Handle 104, Tang 114, and 2nd Knife Handle 105 attaching the three pieces in parallel and firmly in plane.

Second Handle 105 in the preferred embodiment has 2nd Handle Recess 308 disposed in the end of 2nd Handle 105 to accommodate Tool Lip 407 (not shown) of Tool 110 adding rigidity to Tool 110 while increasing the wear resistance of Knife Base 116. It has also been contemplated to construct Tool 110 without Tool Lip 407 thereby eliminating the need for 2nd Handle Recess 308 in 2nd Handle 105.

Figure 4A:
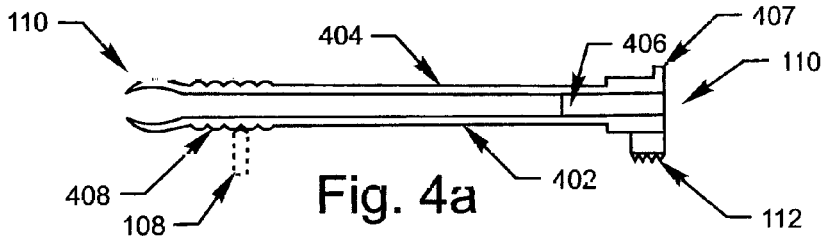
FIG. 4*a* is a top view of a tool of the present invention.

FIG. 4*a* is a top view of Tool 110 of the present invention. Spacer 406 maintains First Leg 402 and 2nd Leg 404 essentially parallel and a distance apart as needed for tweezing or clipping if Tool 110 is a tweezers or a clipper, respectively. FIG. 4*a* shows Tool 110 as a clipper or fishing line nipper. Typically fishermen use fingernail clippers for cutting their line, however, they require opening and rotating to a working position. Tool 110 is easily extracted from Knife 100 and ready to use. The end or nose of Tool 110 is rounded for close cutting and can be easily sharpened. Spacer 406 is the approximate length as the depth of End Recess 208 as shown in FIG. 2 and is sufficiently thicker than Tang 114 such that Tool 110 can freely slide into Knife 100. To put Tool 110 into Knife 100, 1st Leg 402 slides into 1st Receiving Slot 302 of 1st Handle 104 while 2nd Leg 404 slides into 2nd Receiving Slot 304 of 2nd Handle 105. Spacer 406, 1st Leg 402, and 2nd Leg 404 can be assembled by pins or welding.

FIG. 4*a* shows Tool Lip 407 on 2nd Leg 404 that lodges into 2nd Handle Recess 308 of 2nd Handle 105 when Tool 110 is fully inserted into Knife Base 116 of Knife 100.

A series of Serrated Ridges 408 are constructed approximate the end, on the outer surface, and perpendicular to the length of 1st Leg 402 such that when Tool 110 is inserted into Knife Base 116 of Knife 100, Detent Pin 108 (shown in phantom) applies pressure to Serrated Ridges 408. Deflection Slot 206 (shown and discussed in FIG. 2) accommodates the flexing of 1st Leg 402 toward the center of Tang 114 as Tool 110 is inserted. When Tool 110 is fully inserted, Detent Pin 108 lodges between two Serrated Ridges 408 holding Tool 110 firmly in place. It has also been contemplated to have another Thumb Stud 112 in place of Tool Lip 107.

Although the preferred embodiment of the present invention has Tool 110 held in place by lodging Detent Pin 108 between two Serrated Ridges 408, it has been contemplated that in the absence of Detent Pin 108 and Serrated Ridges 408, when the user deflects 1st Leg 402 and 2nd Leg 404 toward one another, the spring force created biases 1st Leg 402 and 2nd Leg 404 outward pressing them against 1st Receiving Slot 302 and 2nd Receiving Slot 304, respectively, holding Tool 110 in place when not in use.

Figure 4B:
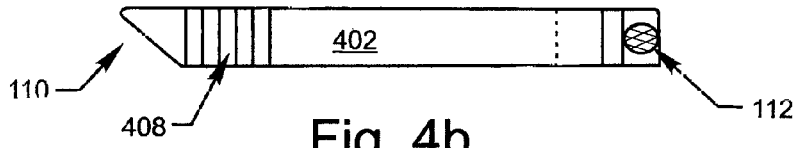
FIG. 4*b* is a side view of a tool of the present invention.

FIG. 4*b* is a side view of Tool 110 illustrating placement of Serrated Ridges 408. In this view, Tool 110 is depicted as heavy-duty field or military tweezers. Although FIG. 4*b* shows several Serrated Ridges 408, two Serrated Ridges 408 properly placed to coincide with Detent Pin 108 may be adequate. Tool 110 of FIGS. 4*a* and 4*b* function with a simple spring action for clipping and tweezing.

Figure 5A:
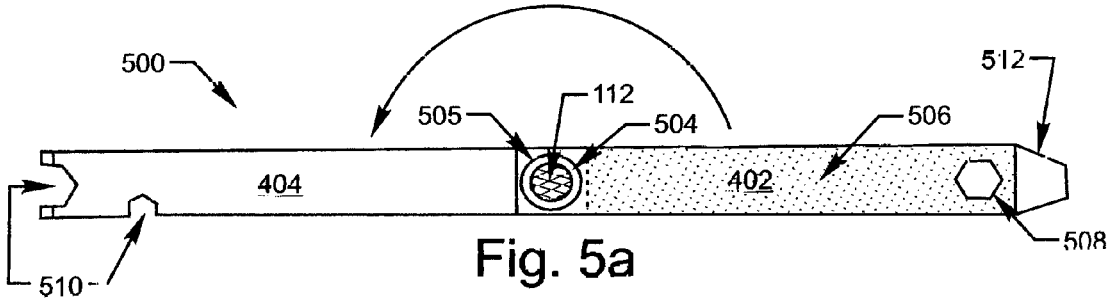
FIG. 5*a* is a top view of an alternate tool for the present invention depicting the tool expanded to an open position.

FIG. 5*a* is a top view of Alternate Tool 500 of the present invention depicting Alternate Tool 500 expanded or rotated to an open position. With Alternate Tool 500 removed from Knife 100, 1st Leg 402 and 2nd Leg 404 can be rotated away from one another to make a long tool as shown in FIG. 5*a*. In this alternate embodiment, 1st Leg 402 of Alternate Tool 500 includes Abrasive Coating 506 that can be used as a file or knife sharpener. Abrasive Coating 506 can be commonly known "diamond coating" or a crosshatched file. Hex Hole 508 is shown extending through 1st Leg 402 and can be used as a hex socket for oxygen tank valves, fishing reel handles, wire strippers and the like. The end of 1st Leg 402 is configured with Screw Driver 512.

FIG. 5*a* shows the inside of 2nd Leg 404. In this alternate embodiment, Alternate Tool 500 is shown in the open position and rotates between the open and closed position within Thumb Sleeve 504 according to the arrow shown. With Alternate Tool 500 in the closed position (1st Leg 402 and 2nd Leg 404 are essential parallel and adjacent to one another), as the user squeezes 1st Leg 402 and 2nd Leg 404 together to insert Alternate Tool 500 into Knife 100, the spring force created biases 1st Leg 402 and 2nd Leg 404 outward asserting pressure against 1st Receiving Slot 302 and 2nd Receiving Slot 304, respectively, thereby holding Alternate Tool 500 in place within Knife 100.

It has also been contemplated to locate Detent Pin 108 such that it lodges into Hex Wrench 510 shown disposed in 2nd Leg 404 for securing Alternate Tool 500 in the Knife 100.

In FIG. 5*a*, Thumb Stud 112 is inserted into Thumb Sleeve 504 extending through and fixedly attached within Sleeve Aperture 505 of 1st Leg 402. The following exploded view shown in FIG. 5*b* details this construction.

Figure 5B:
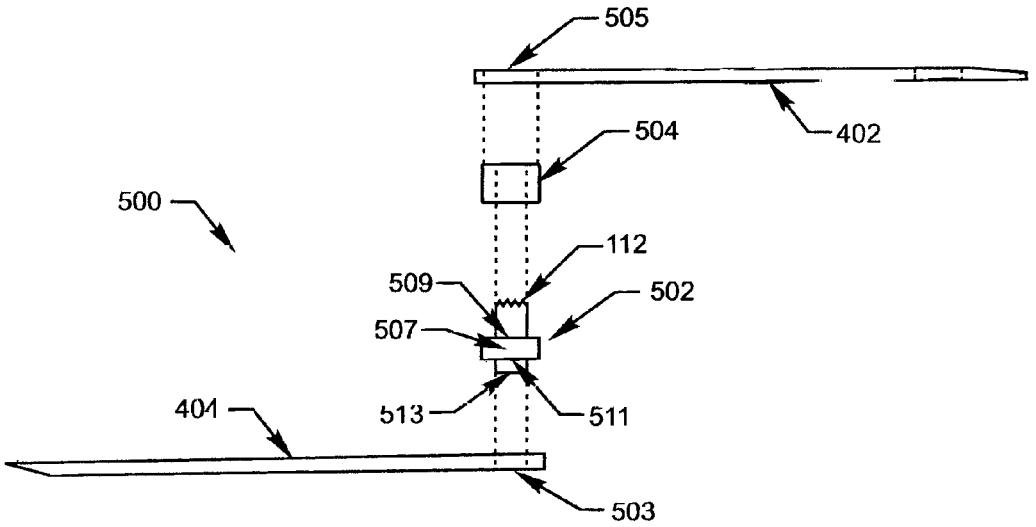
FIG. 5*b* is a side exploded view of the alternate tool of FIG. 5*a*.

FIG. 5*b* is a side exploded view of Alternate Tool 500 of FIG. 5*a*. Thumb Sleeve 504 extends through Sleeve Aperture 505 disposed in 1st Leg 402 and is secured by welding, staking or the like. Spacer Rivet 502, has Rivet Base 513 which is slightly smaller in diameter than Alternate Spacer 507 and extending through and fixedly attached by staking or welding in Rivet Aperture 503. Spacer Bottom 511 rests on the inside surface of 2nd Leg 404. Alternate Spacer 507 functions similarly to Spacer 406 described in FIG. 4*a* such that it is sufficiently thicker than Tang 114 such that Alternate Tool 500 can freely slide into and out of Knife 100 while straddling or bridging Tang 114.

Thumb Stud 112 extends from Spacer 507 of Alternate Spacer Rivet 502 opposite Spacer Base 513. Thumb Stud 112 slides through and extends slightly beyond Thumb Sleeve 504. With Thumb Sleeve 504 attached to 1st Leg 402 and Spacer Rivet 502 attached to 2nd Leg 404, Alternate Tool 500 can be rotated between the open and closed positions as Thumb Stud 112 rotates within Thumb Sleeve 504. The open position allows for a longer, more practical tool, while the closed position functions as a tweezing or clipping device and also allows Alternate Tool 500 to be inserted into the handle of Knife 100.

Figure 6A:
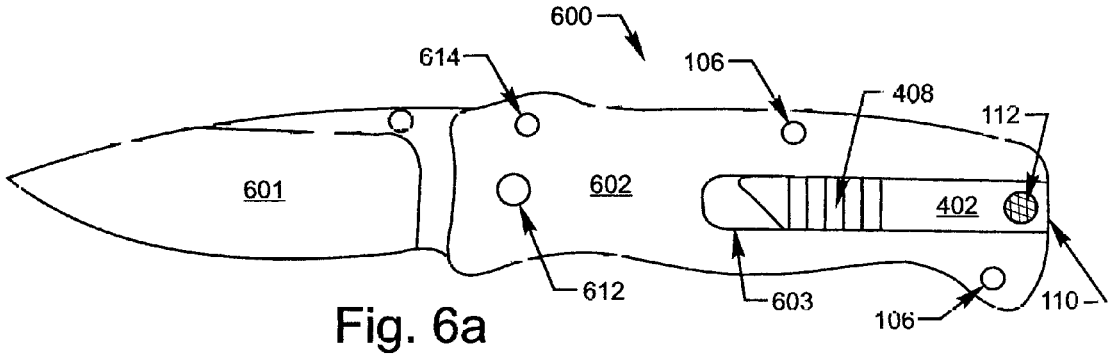
FIG. 6*a* is a side view of a folding knife with the handle removed to show the deflection slot disposed in the liner of the knife and a tool in place.

FIG. 6*a* is a side view of Folding Knife 600 with the handle removed to show 1st Liner Receiving Slot 003 which aligns with 1st Receiving Slot 302 of 1st Handle 104 disposed in 1st Liner 602 of Folding Knife 600 having 2nd Alternate Tool 610 inserted in Folding Knife 600. Blade Pivot Bolt 612 enables Blade 601 to rotate between the open and closed positions.

Figure 6B:
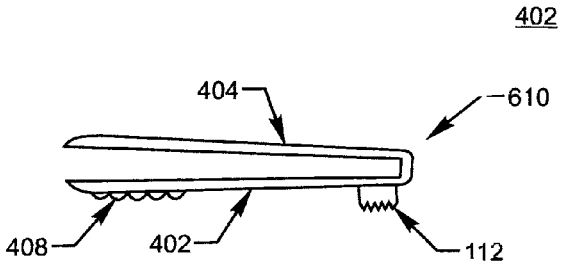
FIG. 6*b* is a top view of the alternate tool of FIG. 6*a*.

FIG. 6*b* is a top view of 2nd Alternate Tool 610 of FIG. 6*a*. Second Alternate Tool 610 is a single piece tool with Thumb Slot 112 attached to 1st Leg 402. Similar to the preferred embodiment of FIG. 4*a*, 1st Leg 402 and 2nd Leg 404 are essentially parallel to one another and spaced apart to allow for spring movement for tweezing or clipping and sliding into Folding Knife 600.

Figure 6C:
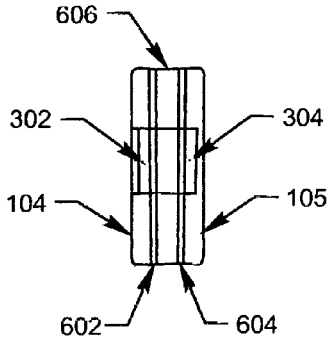
FIG. 6*c* is a rear perspective view of a folding knife of the present invention showing the receiving slot placement within the handles pieces and the liners.

FIG. 6*c* is a rear view of Folding Knife 600 of the present invention. As is common with folding knives, 1st Liner 602 is interior to 1st Handle 104 and 2nd Liner 604 is interior to 2nd Handle 105. Similar to 1st Liner 602, 2nd Liner 604 has 2nd Liner Receiving Slot (not shown) that aligns with 2nd Receiving Slot 305 of 2nd Handle 105 (not shown). Alternate Tang 606 is sandwiched between 1st Liner 602 and 2nd Liner 604 similarly to what is often referred to as an 'inner liner' of a folding knife. Alternate Tang 606 spaces 1st Liner 602 and 2nd Liner 604 apart and is cut out to accommodate the shape of Blade 601 (not shown) when in the closed position. First Receiving Slot 302 is disposed in both 1st Handle 104 and 1st Liner 602 while 2nd Receiving Slot 304 is disposed in both 2nd Handle 105 and 2nd Liner 604. Second Alternate Tool 610 is inserted into the handle portion of Folding Knife 600 by 1st Leg 402 and 2nd Leg 404 straddling or bridging across Inner Liner 606. The ability to bridge across Inner Liner 606, allows for a more robust, practical tool or instrument as there is only one leg in each side of the handle.

Wherein the terms and expressions which have been employed in the specification are used as terms of description and not of limitation, there is no intention, in the use of such terms and expressions, of excluding equivalents of the features shown and described or portions thereof, it being recognized that the scope of the invention is defined and limited only by the claims which follow.

I claim:

1. A knife having a blade at a distal end and a knife base at an opposite end, comprising:

a tang having a thickness and an end recess having a depth at the knife base;

a first handle having a first handle recess and a first handle interior surface having a first handle receiving slot disposed lengthwise approximately centered on the first handle interior surface;

a second handle having a second handle interior surface having a second handle receiving slot disposed lengthwise approximately centered on the second handle interior surface;

a spacer having a spacer thickness slightly greater than the thickness of the tang and a spacer length approximate the depth of the end recess;

a tool having a first leg having a first leg end and a second leg having a second leg end, the first leg and the second leg are essentially parallel and attached to either side of the spacer at the first leg end and the second leg end; and, a thumb stud disposed on the first leg approximate the first leg end on a side opposite the spacer;

wherein, the first handle interior surface is attached to the tang on a first tang side and the second handle interior surface is attached to the tang on a second tang side, the tool is inserted into the knife at the knife base by the first leg and the second leg entering the first handle receiving slot and the second handle receiving slot, respectively, while straddling the tang and the spacer is lodged into the end recess of the tang while the thumb stud lodges into the first handle recess such that the thumb stud protrudes slightly from the first handle such that a user contacts the thumb stud to slide the tool into and out of the knife.

2. The knife of claim 1, further comprising:

a deflection slot disposed interior to and approximately centered on the tang;

at least two serrated ridges disposed across an outer surface of the first leg; and a detent pin attached to and disposed through the first handle, the detent pin having a end extending toward the tang;

wherein, as the tool is inserted into the knife base the end of the detent pin presses against the serrated ridges deflecting the first leg into the deflection slot and holding the tool firmly in place by the detent pin lodging between two of the serrated ridges.

3. The knife of claim 2, wherein the detent pin is a removable ball screw.

4. The knife of claim 2, wherein the detent pin is stainless steel.

5. The knife of claim 2, wherein the detent pin is ceramic.

6. A knife having a blade at a distal end and a knife base at an opposite end, comprising:

a tang having a thickness and an end recess having a recess size approximate that of the end recess of the tang having a depth at the knife base;

a first handle having a first handle recess and a first handle interior surface having a first handle receiving slot disposed lengthwise approximately centered on the first handle interior surface;

a second handle having a second handle interior surface having a second handle receiving slot disposed lengthwise approximately centered on the second handle interior surface;

a tool having a first leg having a first leg end and a second leg having a second leg end, the first leg and the second leg are parallel and spaced apart slightly greater than the thickness of the tang; and, a thumb stud disposed on the first leg opposite the first leg end exterior to the tool;

wherein, the first handle interior surface is attached to the tang on a first tang side and the second handle interior surface is attached to the tang on a second tang side opposite the first tang side, the tool is inserted into the knife at the knife base by the first leg end and the second leg end entering the first handle receiving slot and the second handle receiving slot, respectively, while straddling the tang, the tool is lodged into the end recess of the tang while the thumb stud lodges into the first handle recess such that the thumb stud protrudes slightly from the first handle such that a user contacts the thumb stud with a user's thumb to slide the tool into and out of the knife.

7. The knife of claim 6, further comprising:

a first liner having a first liner receiving slot disposed between the first handle and the tang such that the first liner receiving slot aligns with the first receiving slot of the first handle; and a second liner having a second liner receiving slot disposed between the second handle and the tang on a side opposite the first liner such that the second liner receiving slot aligns with the second receiving slot of the second handle;

wherein, the first leg end enters first receiving slot and first liner receiving slot simultaneously and the second leg end enters second receiving slot and second liner receiving slot simultaneously, thereby lodging the tool into the knife base of the knife.

8. The knife of claim 6 is a pocket knife.

9. The knife of claim 6, further comprising:

at least two serrated ridges disposed across an outer surface of the first leg; and a detent pin attached to and disposed through the first handle and the first liner, the detent pin having a end extending toward the tang;

wherein, as the tool is inserted into the knife base, the end of the detent pin presses against the serrated ridges deflecting the first leg into the first liner and an outward spring force biases the first leg outward holding the tool firmly in place by the detent pin lodging between two of the serrated ridges.

10. The knife of claim 2, wherein the detent pin is a removable ball screw.

11. The knife of claim 2, wherein the detent pin is stainless steel.

12. The knife of claim 2, wherein the detent pin is ceramic.

13. The knife of claim 7, wherein the tang is an alternate tang.

14. The knife of claim 13 is a folding knife.

15. The knife of claim 6, further comprising:

a spacer having a spacer thickness slightly greater than the thickness of the tang and a spacer length approximate the depth of the end recess, wherein the first leg end and the second leg end are attached to either side of the spacer.

16. The knife of claim 6, further comprising:

a sleeve aperture disposed in the first leg;

a thumb sleeve disposed in and fixedly attached in the sleeve aperture;

a spacer rivet has an alternate spacer having the thumb stud extending from a spacer top and a rivet base extending from a spacer bottom;

a rivet aperture is disposed in the second leg;

wherein, the rivet base is disposed in the rivet aperture and fixedly attached to the second leg, the thumb stud extends through the thumb sleeve such that the thumb stud rotates within the thumb sleeve thereby allowing the tool to rotate between a closed position and an extended position.

17. The knife of claim 16, further comprises, a screw driver on the first leg end.

18. The knife of claim 16, further comprises, a hex hole disposed in the first leg.

19. The knife of claim 16, further comprises, a hex wrench disposed in the second leg end.

20. The knife of claim 16, further comprises, an abrasive coating on the first leg.

* * * * *